US005181395A

United States Patent [19]

Carpenter et al.

[11] Patent Number: 5,181,395

[45] Date of Patent: Jan. 26, 1993

[54] CONDENSER ASSEMBLY

[76] Inventors: Donald Carpenter, 15239 Doty Ave., Lawndale, Calif. 90260; Craig Kushen, 447 Herondo No. 208, Hermosa Beach, Calif. 90254

[21] Appl. No.: 675,483

[22] Filed: Mar. 26, 1991

[51] Int. Cl.[5] ..... F25B 39/04

[52] U.S. Cl. ..... 62/506; 62/298; 165/76; 165/110

[58] Field of Search ..... 62/506, 507, 298, 508; 165/76, 110

[56] References Cited

U.S. PATENT DOCUMENTS

| | | | |
|---|---|---|---|
| 3,138,941 | 6/1964 | Jensen | 62/507 |
| 3,305,006 | 2/1967 | Daltry | 165/110 |
| 3,466,889 | 9/1969 | Fristoe et al. | 62/507 |
| 3,857,253 | 12/1974 | Burgett et al. | 62/507 |
| 4,191,029 | 3/1980 | Dunne | 62/507 |
| 4,580,401 | 4/1986 | Ruscheyh | 165/110 |
| 4,727,728 | 3/1988 | Brown | 62/298 |

*Primary Examiner*—Ronald C. Capossela

[57] ABSTRACT

Disclosed is a unique compressor assembly used with remote refrigeration systems. The refrigeration system has a housing which encloses a compressor and the condenser assembly. The condenser assembly comprises a plurality of modular panel elements mounted in a V-shaped configuration with the apex of the V-shaped panel configuration being near the bottom of the housing and the mouth of the V-shaped panel configuration pointing upwardly towards the top of the housing. An exhaust fan is in the top of the housing overlying the mouth of the V-shaped panel configuration.

3 Claims, 4 Drawing Sheets

CONDENSER ASSEMBLY

BACKGROUND OF THE INVENTION

1. Field of the Invention:

This invention relates to remote refrigeration systems for large scale facilities such as restaurants and hotels. Such systems are custom designed to provide refrigeration for walk-in boxes and various other refrigeration fixtures in a facility. The present invention employs a uniquely configured condenser member used in the system.

2. Background Discussion:

It is conventional for the condenser member for remote refrigeration systems to employ a relatively large, one piece, unitary condenser which is bulky and difficult to remove if it needs to be repaired. This condenser may be damaged or otherwise spring leaks which require that it be repaired or replaced. This normally requires the entire refrigeration system to be shut down, sometimes for substantial periods of time while this repair work is conducted.

SUMMARY OF THE INVENTION

It is the objective of this invention to provide a condenser assembly for remote refrigeration systems that is relatively compact, and employs condenser panels which are easy to install, remove or replace without the need for prolonged shutdown of the refrigeration system.

The condenser assembly of this invention has several features, no single one of which is solely responsible for its desirable attributes. Without limiting the scope of this invention as expressed by the claims which follow, its more prominent features will now be discussed briefly. After considering this discussion, and particularly after reading the section of this application entitled, "DETAILED DESCRIPTION OF THE PREFERRED EMBODIMENT," one will understand how the features of this invention provide its advantages, which include its compact, space saving design, and ease of repair.

One of the features of this invention is that the condenser comprises a plurality of modular condenser panels. Thus, if a panel springs a leak or otherwise needs to be repaired, only the damaged panel is removed without the need to disassemble other sections of the refrigeration system. In contrast, in conventional systems the entire condenser unit requires removal, resulting in prolonged shutdown of the entire refrigeration system while the condenser unit is repaired. With the present invention, only the refrigeration compressor that is tied into the damaged condenser is shut down briefly, while the rest of the refrigeration system may remain operational. The second feature of this invention is that the modular condenser panels are arranged in a V-shaped configuration. This provides a compact, space saving assembly.

BRIEF DESCRIPTION OF THE DRAWING

The preferred embodiment of this invention, illustrating all its features, will now be discussed in detail. This embodiment depicts the novel and non-obvious condenser assembly of this invention, which is shown in the accompanying drawing that is for illustrative purposes only. This drawing includes the following Figures, with like numerals indicating like parts.

DETAILED DESCRIPTION OF THE PREFERRED EMBODIMENT

Figure 1:
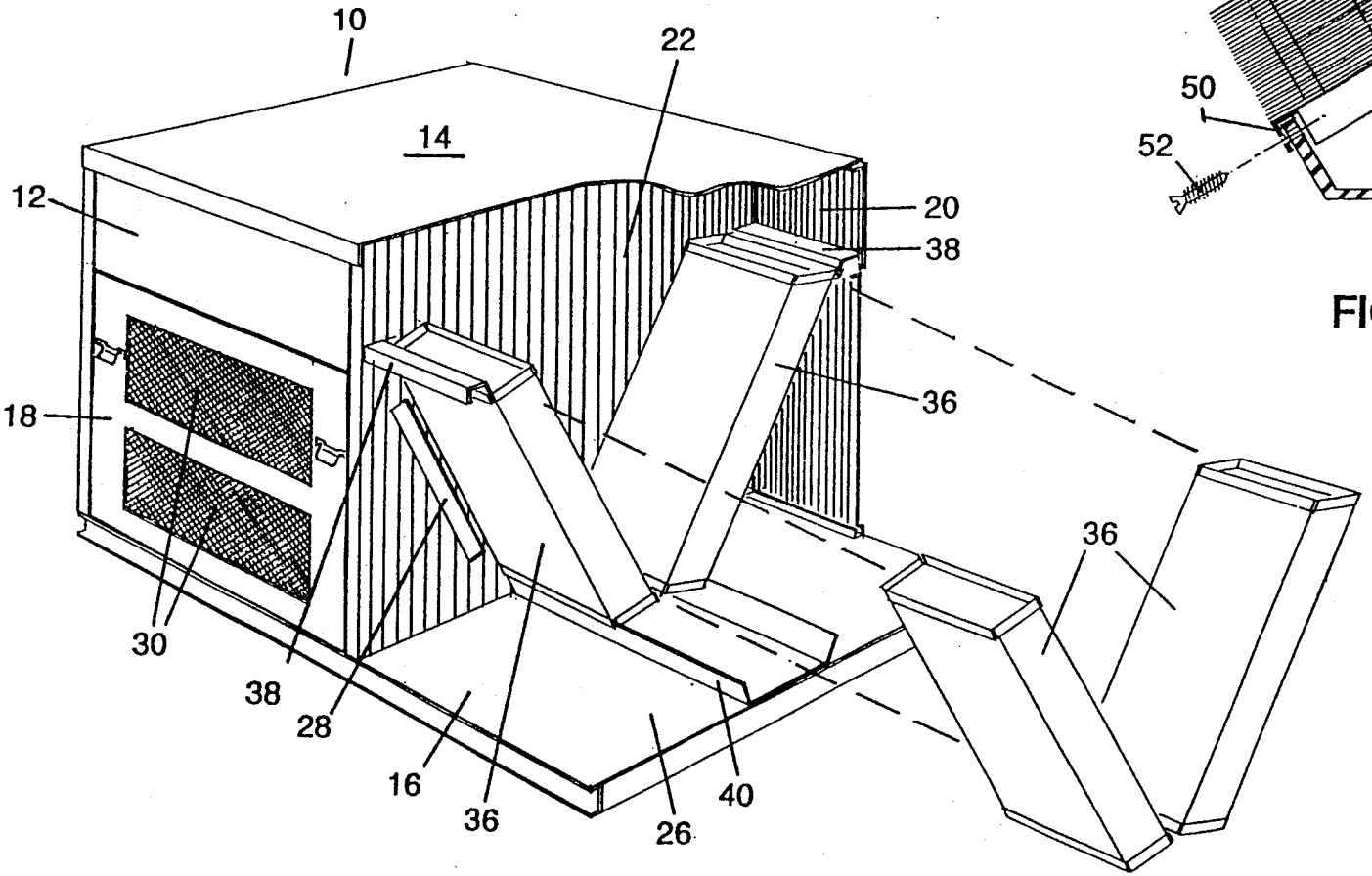
FIG. 1 is a perspective view of a refrigeration system, with sections broken away, showing the condenser assembly of this invention.
Figure 2:
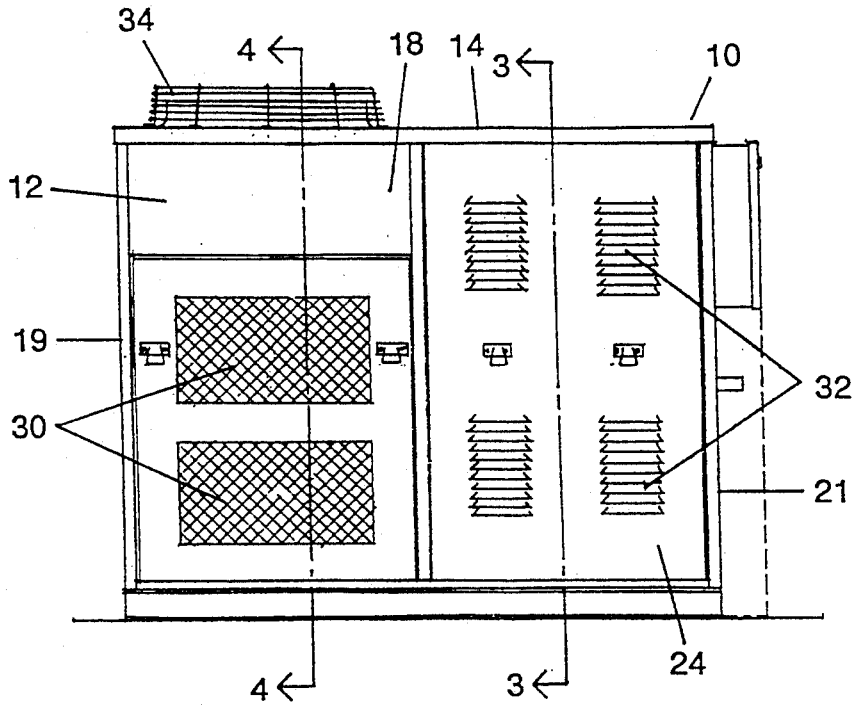
FIG. 2 is a side elevational view of the refrigeration system shown in FIG. 1.
Figure 3:
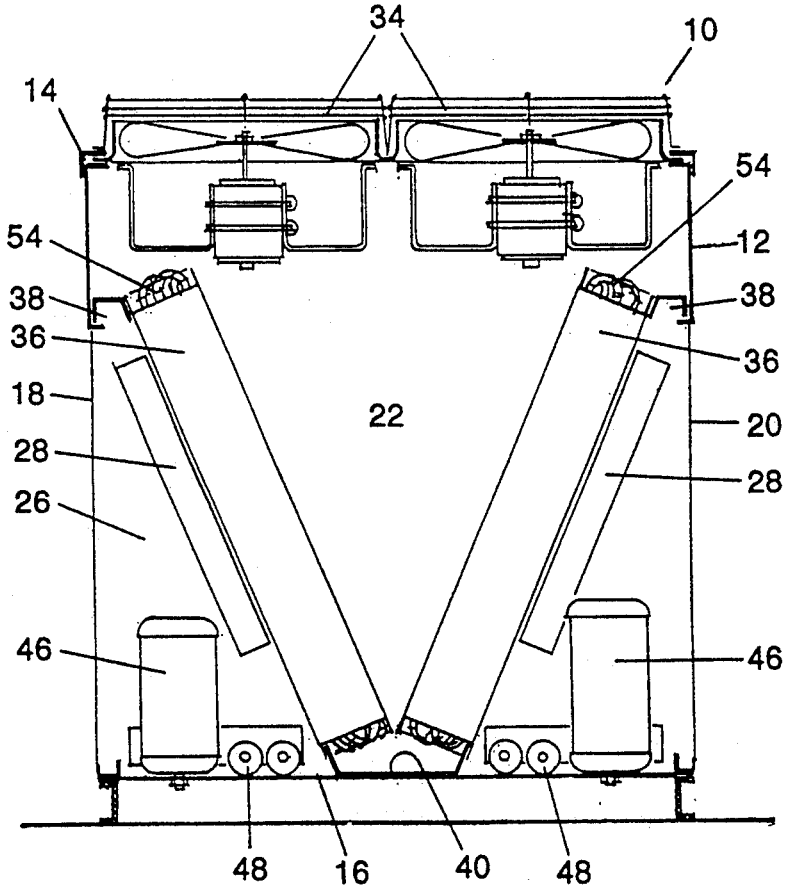
FIG. 3 is a cross-sectional view of the condenser section taken along line 3 of FIG. 2.
Figure 4:
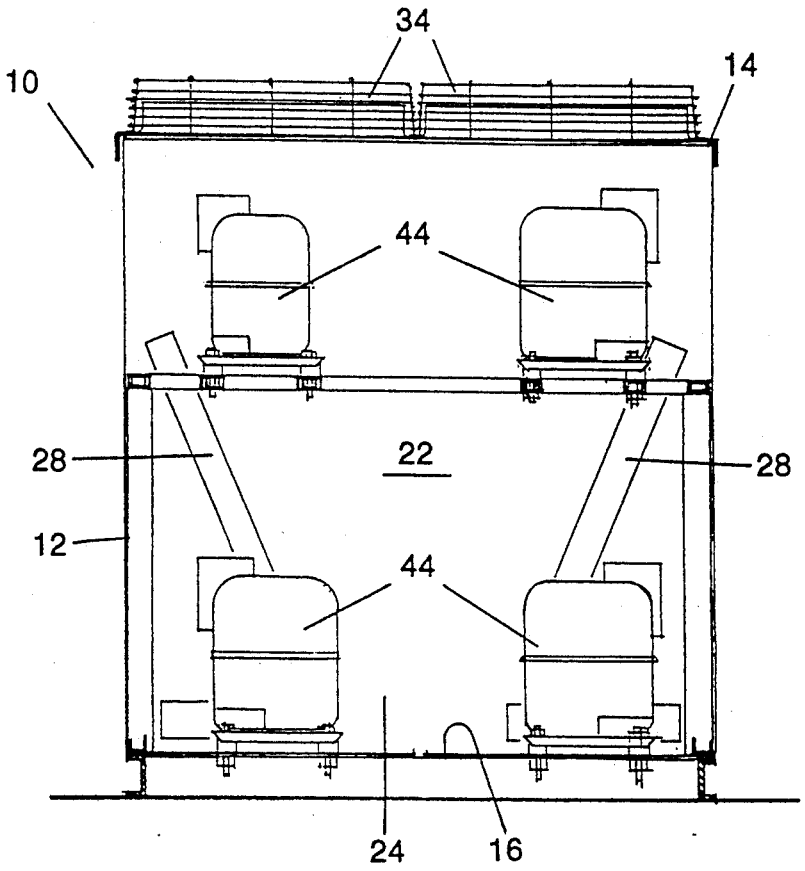
FIG. 4 is a cross-sectional view taken along line 4 of FIG. 2, showing the compressors.
Figure 5:
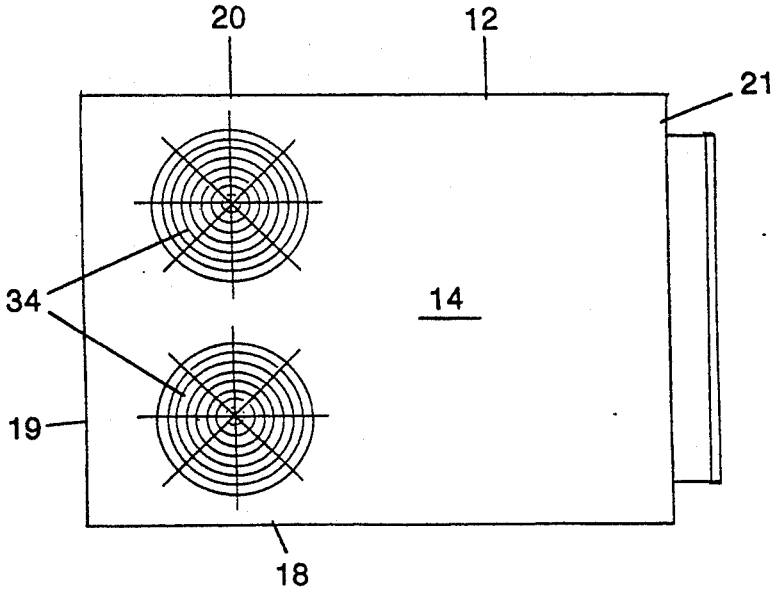
FIG. 5 is a top plan view of the refrigeration system.
Figure 6:
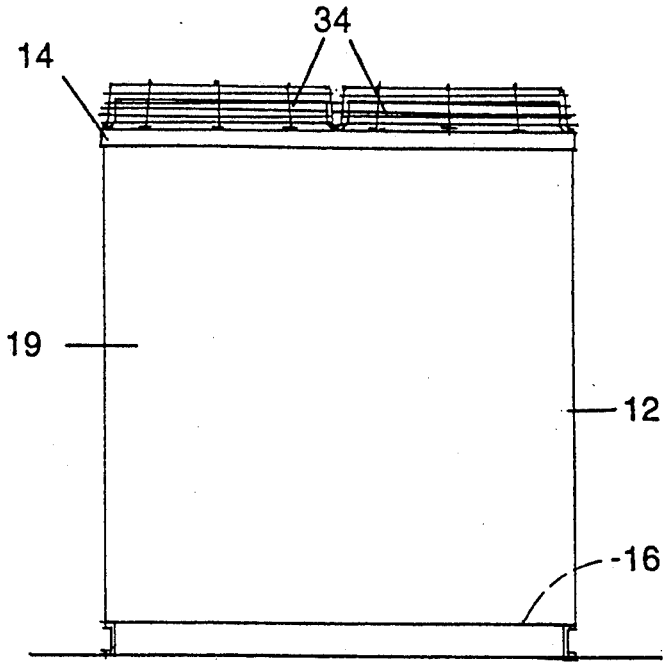
FIG. 6 is a left-hand end elevational view of the refrigeration system.
Figure 7:
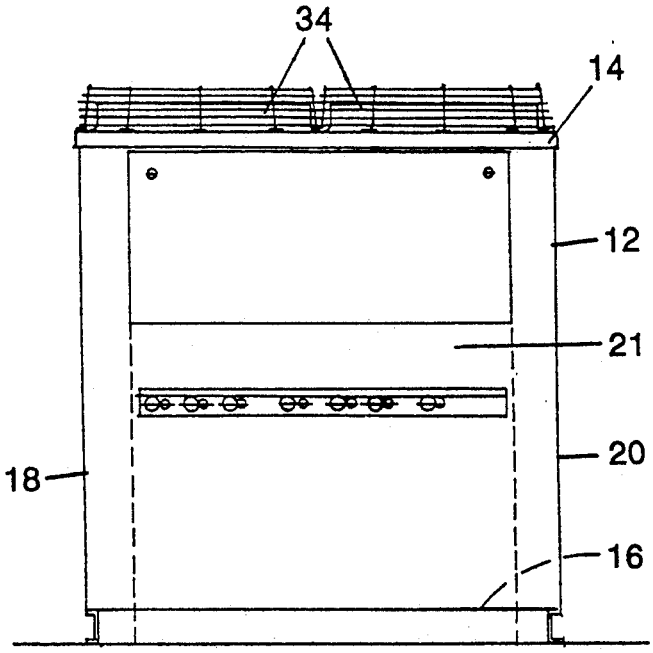
FIG. 7 is a right-hand end elevational view of the refrigeration system.

As best illustrated in FIGS. 1, 3 and 4, a remote refrigeration system 10 using the present invention includes a generally box-like housing 12 having a top 14, a bottom 16 and four side walls 18–21 connecting the top and bottom. An internal, generally vertical partition wall 22 divides the housing 12 into a compressor section 24 and a condenser section 26. This partition wall 22 has air-circulation slots 28 in it and the side walls 18 and 20 have screened windows 30 and louvers 32 to allow air to flow into the housing. In the top 14 are located a pair of horizontal discharge fans 34 which, when activated, draw air into the housing 12 through the windows 30 and louvers 32, pulling air through the air circulation slots 28 and blowing it out the top. Compressors 44 are mounted in the compressor section 24.

Figure 8:
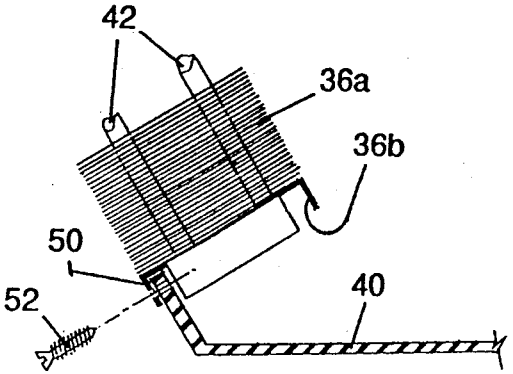
FIG. 8 is a fragmentary cross-sectional view of one of the mounting brackets for a condenser panel.

In accordance with one of the main features of this invention, the condenser employed comprise a plurality of modular condenser panels 36 mounted in a generally V-shaped configuration. This V-shaped configuration provides a compact, space saving design that affords easy access to individual panels if they need to be replaced or repaired. Two spaced apart, inverted, U-shaped brackets 38 extend between the partition wall 22 and front wall 19. The panels are mounted on brackets 38 and 40. The brackets 38 have a generally U-shaped cross-section and are mounted in an inverted position, spaced apart from each other and aligned in parallel, extending between the partition wall 22 and the side wall 19. The bracket 40 is an enlarged U-shaped bracket 40 having a generally flat face which is screwed to the bottom 16 of the housing 12. As illustrated in FIG. 8, there are end-caps **36*b* at each end of the panels 36 which have a leg 50 which fits over the bracket 40 and rest against on brackets 38. These end-caps 36*b* are attached to the brackets 38 and 40 by sheet metal screws 52**.

The individual condenser panels 36 are composed of a plurality of spaced apart, parallel fins **36*a* connected to tubing 42 that feeds coolant from the compressors 44 through the tubing-fins into receivers 46 (FIG. 3) and then to dryers 48 (FIG. 3). The coolant is continually circulated through the refrigeration system 10 during operation. If for any reason a panel 36 is damaged, it can be readily removed. This is accomplished by first shutting down the compressor tied into the damaged panel. Then unscrewing the screws 52 attaching the end-caps 36*b* to the brackets 38 and 40 and cutting the lines 54, removing the damaged panel from the refrigeration system 10. The lines 54** are reconnected by soldering to allow the coolant to circulate through the replaced panels. This can be accomplished in a matter of minutes.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

We claim:

1. A remote refrigeration system, including a housing having a bottom, a top, a compressor section in which is housed one or more compressors, and a condenser section in which is housed a condenser assembly, said condenser assembly comprising a plurality of panel elements mounted in a V-shaped configuration with the apex of the V-shaped panel configuration near the bottom of the housing and the mouth of the V-shaped panel configuration pointing upwardly towards the top of the housing, each panel element comprising a plurality of spaced apart, parallel fins connected to tubing means that is disposed generally vertically, said fins being generally at a right angle to the tubing means, said tubing means carrying coolant which is circulated to the compressors, means for readily removing said panel elements from the condenser assembly, and means for exhausting air in the top of the housing overlying the mouth of the V-shaped panel configuration.

2. The remote refrigeration system of claim 1 wherein the housing includes removable wall members between the bottom of the housing and the top of the housing which upon removal provide access to the compressor section and the condenser section.

3. A remote refrigeration system, including a housing having a bottom, a top, removable side walls, a compressor section, and a condenser section, said compressor section and condenser section having vents that allow air to be drawn through the housing, a compressor within the compressor section, a condenser assembly within the condenser section, said condenser assembly comprising a plurality of modular panel elements removably mounted to bracket members within the condenser section, said panels being mounted to form a V-shaped configuration with the apex of the V-shaped panel configuration pointing towards the bottom of the housing and the mouth of the V-shaped panel configuration pointing upwardly towards the top of the housing, each panel comprising a plurality of spaced apart, parallel fins connected to tubing means that is disposed generally vertically, said fins being generally at a right angle to the tubing means, said tubing means carrying coolant which is circulated to the compressor, and a fan in the top of the housing overlying the mouth of the V-shaped panel configuration for exhausting air from the housing.

* * * * *